US012078383B2

(12) United States Patent
Miyawaki et al.

(10) Patent No.: US 12,078,383 B2
(45) Date of Patent: Sep. 3, 2024

(54) INDOOR UNIT OF AIR-CONDITIONING APPARATUS AND AIR-CONDITIONING APPARATUS

(71) Applicant: Mitsubishi Electric Corporation, Tokyo (JP)

(72) Inventors: Kosuke Miyawaki, Tokyo (JP); Yoji Onaka, Tokyo (JP); Tomoya Fukui, Tokyo (JP); Kenichi Sakoda, Tokyo (JP); Shota Morikawa, Tokyo (JP); Shoji Yamada, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 587 days.

(21) Appl. No.: 17/416,515

(22) PCT Filed: Feb. 7, 2019

(86) PCT No.: PCT/JP2019/004349
§ 371 (c)(1),
(2) Date: Jun. 21, 2021

(87) PCT Pub. No.: WO2020/161847
PCT Pub. Date: Aug. 13, 2020

(65) Prior Publication Data

US 2022/0082294 A1 Mar. 17, 2022

(51) Int. Cl.
*F24F 13/22* (2006.01)
*F24F 1/0063* (2019.01)
*F24F 1/0025* (2019.01)

(52) U.S. Cl.
CPC ..... *F24F 13/222* (2013.01); *F24F 1/0063* (2019.02); *F24F 1/0025* (2013.01); *F24F 13/22* (2013.01)

(58) Field of Classification Search
CPC ..... F24F 1/0007; F24F 1/0018; F24F 1/0063; F24F 13/22; F24F 13/222
See application file for complete search history.

(56) References Cited

U.S. PATENT DOCUMENTS 3,289,746 A * 12/1966 Kline ..... F24F 1/005 165/123
2012/0018117 A1* 1/2012 Yamada ..... F24F 1/0063 165/104.34

(Continued)

FOREIGN PATENT DOCUMENTS

JP 09-33096 A 2/1997
JP 2000-274721 A 10/2000

(Continued)

OTHER PUBLICATIONS

Japanese Office Action dated Apr. 26, 2022, issued in corresponding Japanese patent application No. 2020-570280.

(Continued)

*Primary Examiner* — Joseph F Trpisovsky
(74) *Attorney, Agent, or Firm* — XSENSUS LLP

(57) ABSTRACT

An indoor unit of an air-conditioning apparatus includes a fan, a heat exchanger, and a drain receiver. The interior of the housing is partitioned into a first space and a second space in an axial direction of the rotating shaft of the fan. In the first space, a first opening is provided to allow air to flow out toward a region located outward of the fan in the first space in a radial direction of the fan. In the second space, no opening is provided and a region located outward of the fan in the second space is closed in the radial direction of the fan. In at least part of a space between the fan in the first space and the heat exchanger, a first water receiving device is provided at a higher position than the drain receiver.

12 Claims, 14 Drawing Sheets

(56) References Cited

U.S. PATENT DOCUMENTS

| | | | | |
|---|---|---|---|---|
| 2013/0167578 | A1* | 7/2013 | Ikeda | F24F 1/0011 62/412 |
| 2014/0102676 | A1 | 4/2014 | Tadokoro et al. | |

FOREIGN PATENT DOCUMENTS

| | | | |
|---|---|---|---|
| JP | 2009-63203 | A | 3/2009 |
| JP | 2012-73024 | A | 4/2012 |
| JP | 2012-255628 | A | 12/2012 |
| JP | 2015-230129 | A | 12/2015 |
| JP | 2018-124016 | A | 8/2018 |

OTHER PUBLICATIONS

Chinese Office Action dated May 7, 2022, issued in corresponding Chinese patent application No. 201980090383.7.

International Search Report and Written Opinion mailed on Apr. 9, 2019, received for PCT Application PCT/JP2019/004349, Filed on Feb. 7, 2019, 11 pages including English Translation.

* cited by examiner

INDOOR UNIT OF AIR-CONDITIONING APPARATUS AND AIR-CONDITIONING APPARATUS

CROSS-REFERENCE TO RELATED APPLICATION

The present application is based on PCT filing PCT/JP2019/004349, filed Feb. 7, 2019, the entire contents of which are incorporated herein by reference.

TECHNICAL FIELD

The present disclosure relates to an indoor unit of an air-conditioning apparatus, which includes a fan and a heat exchanger, and also relates to an air-conditioning apparatus.

BACKGROUND ART

In existing air-conditioning apparatuses, in order to reduce the size of the housing, a heat exchanger is inclined in such a manner as to extend over a fan (see, for example, Patent Literature 1).

CITATION LIST

Patent Literature

Patent Literature 1: Japanese Unexamined Patent Application Publication No. 2015-230129

SUMMARY OF INVENTION

Technical Problem

In a cooling operation, a heat exchanger serves as an evaporator. When the heat exchanger is provided in such a manner as to extend over a fan as in a technique described in Patent Literature 1, the a cooling operation in which the heat exchanger operates as an evaporator, gravity and the inertial force of airflow act on dew condensation water generated on fins. The dew condensation water subjected to the inertial force flows from the fins into an air passage and is drawn off through an air outlet. Thus, water flies off from the indoor unit into a living space for a user.

In a given method of avoiding occurrence of the above problem, for example, the inclination angle of the heat exchanger is decreased. However, in this case, because of lack of an installation space in the housing, the heat transfer area of the heat exchanger is reduced, thus deteriorating an energy consumption performance.

In the case where the heat exchanger is provided close to an outer peripheral surface of the fan in order to reduce the size of the indoor unit, water is drawn, for example, at an end portion of a drain receiver. Consequently, water drips or flies off from the outlet for airflow into a room.

In such a manner, in the case of reducing the size of the indoor unit, it is impossible to simultaneously achieve both improvement of the energy consumption performance and improvement of quality that is achieved by, for example, reducing the probability that water will drip or fly off.

The present disclosure is applied to solve the above problem, and relates to an indoor unit of an air-conditioning apparatus and an air-conditioning apparatus that are capable of achieving both improvement in energy consumption performance and improvement of quality that is achieved by, for example, reducing a phenomenon in which water drips or flies off.

Solution to Problem

An indoor unit of an air-conditioning apparatus according to an embodiment of the present disclosure includes: a fan including a rotating shaft that extends in a lateral direction in a housing; a heat exchanger provided in the housing and upstream of the fan in an air passage; and a drain receiver configured to receive water generated in the housing, at a position close to a lower end of the heat exchanger. The interior of the housing is partitioned into a first space and a second space in an axial direction of the rotating shaft of the fan. In the first space, a first opening is provided to allow air to flow out toward a region located outward of the fan in the first space in a radial direction of the fan. In the second space, no opening is provided and a region located outward of the fan in the second space in the radial direction of the fan is closed. In at least part of a space between the fan and the heat exchanger in the first space, a first water receiving device is provided at a higher position than the drain receiver.

An air-conditioning apparatus according to another embodiment of the present disclosure includes the above indoor unit of an air-conditioning apparatus.

Advantageous Effects of Invention

In the indoor unit of an air-conditioning apparatus and the air-conditioning apparatus according to the embodiments of the present disclosure, in the first space in which the first opening is provided to communicate with a living space for a user, the first water receiving device is provided to prevent dew condensation water from dripping from the heat exchanger to the fan, whereby it is possible to reduce occurrence of a phenomenon in which water drips from the heat exchanger to the first opening. In the second space, since no opening for exhaustion of airflow is provided, the direction of airflow is changed, in a space between the heat exchanger and the fan, from a direction perpendicular to the axial direction of the rotating shaft of the fan to the axial direction of the rotating shaft. Therefore, in the second space, it is possible to reduce occurrence of a phenomenon in which water drips or files off into the living space, which is caused by the inertial force of airflow. Thus, the heat exchanger can be inclined to achieve a high-density arrangement of components, and it is possible to improve an energy consumption performance and reduce occurrence of a phenomenon in which water drips or files into the living space. Therefore, it is possible to achieve both improvement of the energy consumption performance and improvement of quality that is achieved by, for example, reducing occurrence of a phenomenon in which water drips or files off.

DESCRIPTION OF EMBODIMENTS

Figure 1:
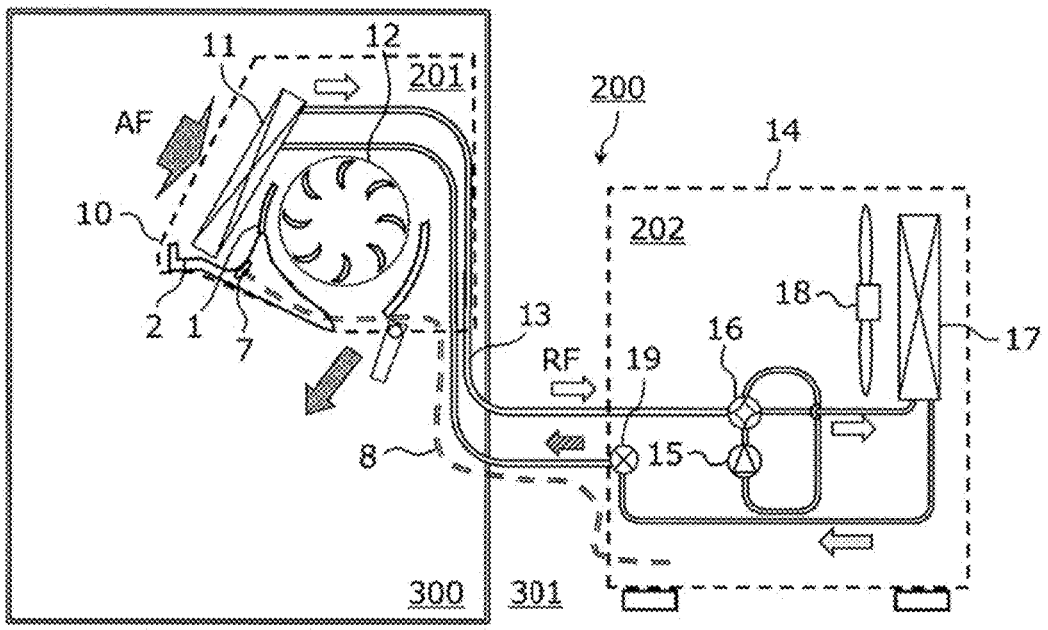
FIG. 1 is a refrigerant circuit diagram illustrating an air-conditioning apparatus according to Embodiment 1 of the present disclosure.

Embodiments of the present disclosure will be described with reference to the figures. In each of the figures, components that are the same as or equivalent to those in a previous figure or figures are denoted by the same reference numerals. The same is true of the entire text of the present specification. In the sectional views, hatching is appropriately omitted for visibility. Furthermore, the configurations of components described in the entire text of the present specification are merely examples. That is, the configurations of the components are not limited to those decried in the entire text.

Embodiment 1

<Configuration of Air-Conditioning Apparatus 200>

FIG. 1 is a refrigerant circuit diagram illustrating an air-conditioning apparatus 200 according to Embodiment 1 of the present disclosure. The air-conditioning apparatus 200 as illustrated in FIG. 1 includes an indoor unit 201 and an outdoor unit 202. Referring to FIG. 1, the indoor unit 201 and the outdoor unit 202 are connected by refrigerant pipes 13. Arrow RF indicates the flow of refrigerant in a cooling operation.

The outdoor unit 202 is installed in an outdoor space 301 that is located outside a residential space. The outdoor unit 202 includes a compressor 15, a four-way valve 16, an outdoor heat exchanger 17, a fan 18, and an expansion device 19 that are located in a housing 14.

The indoor unit 201 is installed in a living space 300. The indoor unit 201 includes a heat exchanger 11, a fan 12, and a drain receiver 2. Arrow AF indicates the flow of air whose temperature is controlled through the indoor unit 201 in the living space 300.

<Configuration of Indoor Unit 201>

Figure 2:
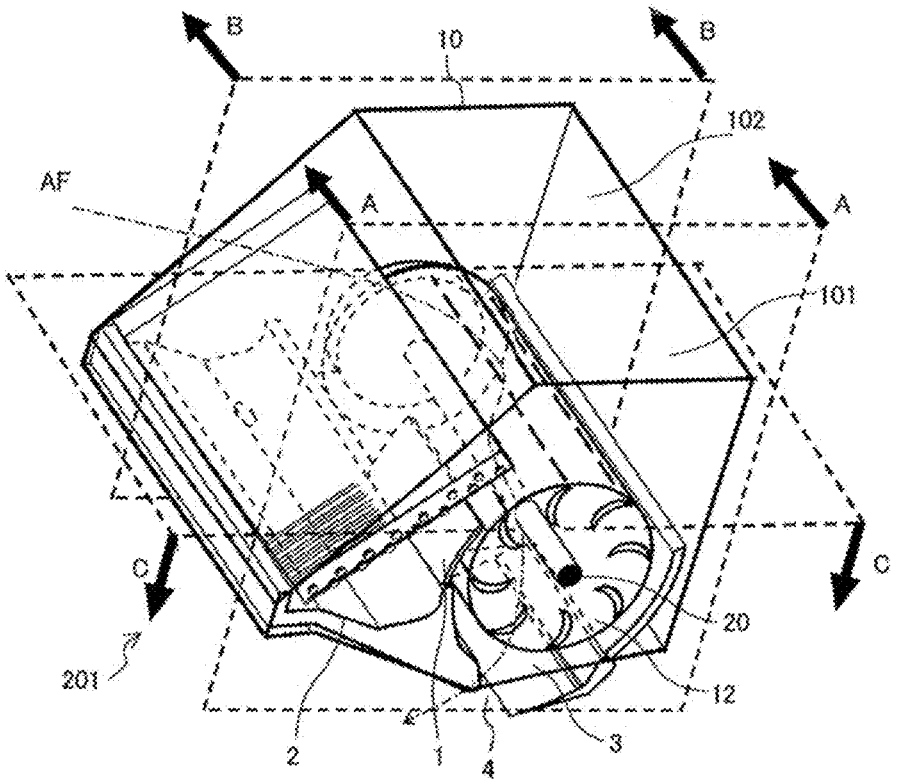
FIG. 2 is a perspective view of an indoor unit according to Embodiment 1 of the present disclosure.
Figure 3:
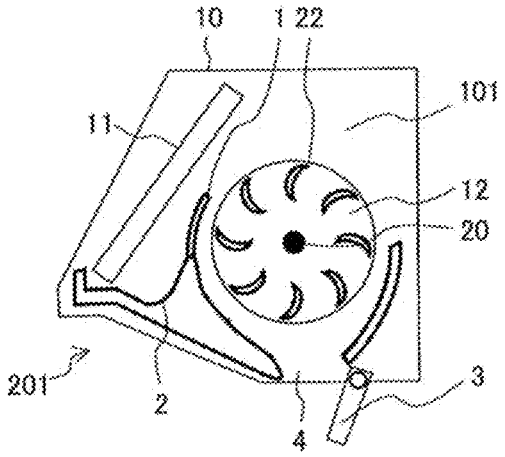
FIG. 3 is an explanatory diagram illustrating a vertical section of the indoor unit according to Embodiment 1 of the present disclosure that is taken along line A-A in FIG. 2.
Figure 4:
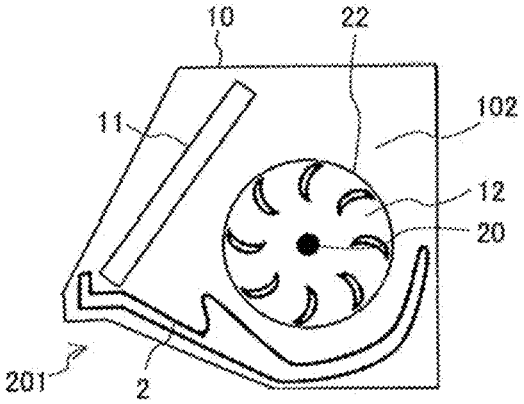
FIG. 4 is an explanatory diagram illustrating a vertical section of the indoor unit according to Embodiment 1 of the present disclosure that is taken along line B-B in FIG. 2.
Figure 5:
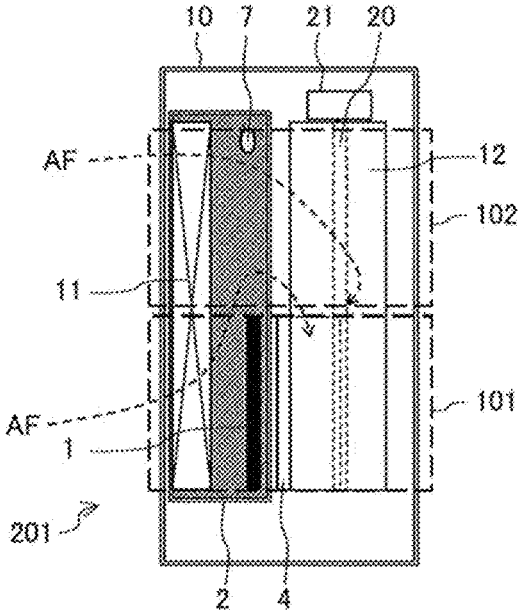
FIG. 5 is an explanatory diagram illustrating a cross section of the indoor unit according to Embodiment 1 of the present disclosure that is taken along line C-C in FIG. 2.

FIG. 2 is a perspective view of the indoor unit 201 according to Embodiment 1 of the present disclosure. FIG. 3 is an explanatory diagram illustrating a vertical section of the indoor unit 201 according to Embodiment 1 of the present disclosure that is taken along line A-A in FIG. 2. FIG. 4 is an explanatory diagram illustrating a vertical section of the indoor unit 201 according to Embodiment 1 of the present disclosure that is taken along line B-B in FIG. 2. FIG. 5 is an explanatory diagram illustrating a cross section of the indoor unit 201 according to Embodiment 1 of the present disclosure that is taken along line C-C in FIG. 2.

The indoor unit 201 has a housing 10 in which various components are provided. The indoor unit 201 includes the heat exchanger 11, the fan 12, and the drain receiver 2.

The fan 12 has a rotating shaft 20 that extends in an axial direction that coincides with a lateral direction such as a horizontal direction, in the housing 10. The fan 12 includes a plurality of blades on an outer peripheral surface of the rotating shaft 20. The fan 12 is rotated by a drive source 21 that drives the rotating shaft 20.

The heat exchanger 11 is an indoor heat exchanger. The heat exchanger 11 is provided in the housing 10 and located upstream of the fan 12 in an air passage. An upper end of the heat exchanger 11 is located at a higher position than the uppermost position of a circular path along which the fan 12 is rotated, in the direction of gravity. A lower end of the heat exchanger 11 is located at a lower position than the rotating shaft 20 of the fan 12 in the direction of gravity.

The drain receiver 2 receives water generated in the housing 10, for example at a position located close to or below the lower end of the heat exchanger 11.

As illustrated in FIG. 2, the housing 10 of the indoor unit 201 is partitioned into a first space 101 and a second space 102 in the axial direction of the rotating shaft 20 of the fan 12. In the first space 101, a first opening 4 is provided to allow to flow out to an outer side in the radial direction of the fan 12. In the second space 102, no opening is provided and an outer side in the radial direction of the fan 12 is closed. The first opening 4 allows air to flow out in the radial direction of the fan 12. The first opening 4 is provided with a vertical air vent deflector 3 that changes the direction of airflow an upward/downward direction.

As illustrated in FIG. 3, in the first space 101, a first water receiving device 1 is provided in at least part of a space between part of the fan 12 that is located in the first space 101 and the heat exchanger 11. The first water receiving device 1 receives water from surfaces of fins 31 of the heat exchanger 11. The first water receiving device 1 is located at a higher position than the drain receiver 2.

As illustrated in FIG. 4, in the second space 102, a second water receiving device 62, which will be described later, is not provided in the space between part of the fan 12 that is located in the second space 102 and the heat exchanger 11, and a large air passage corresponding to the surface area of the first water receiving device 1 in the first space 101 is provided. It should be noted that in the second space 102, the second water receiving device 62 having a surface area smaller than that of the first water receiving device 1 in the first space 101 may be provided.

The drain receiver 2 has a drain hole 7 formed in the lowermost surface of the drain receiver 2. A drain hose 8 is connected between the drain hole 7 and the outdoor unit 202.

<Path of Drainage in Indoor Unit 201>

Figure 6:
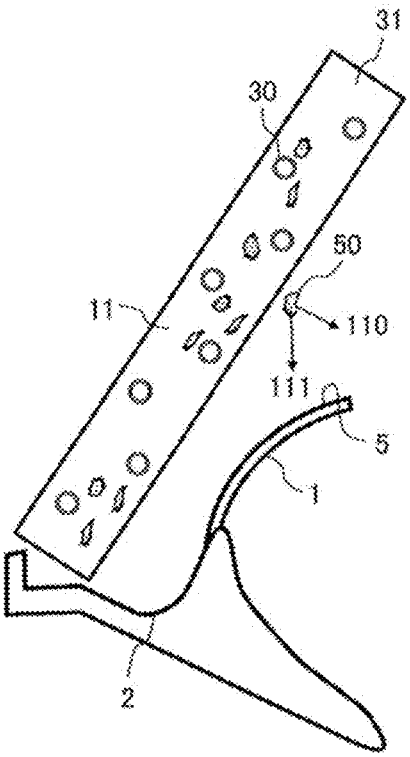
FIG. 6 is a perspective view illustrating a drain path in a heat exchanger in the indoor unit according to Embodiment 1 of the present disclosure.
Figure 7:
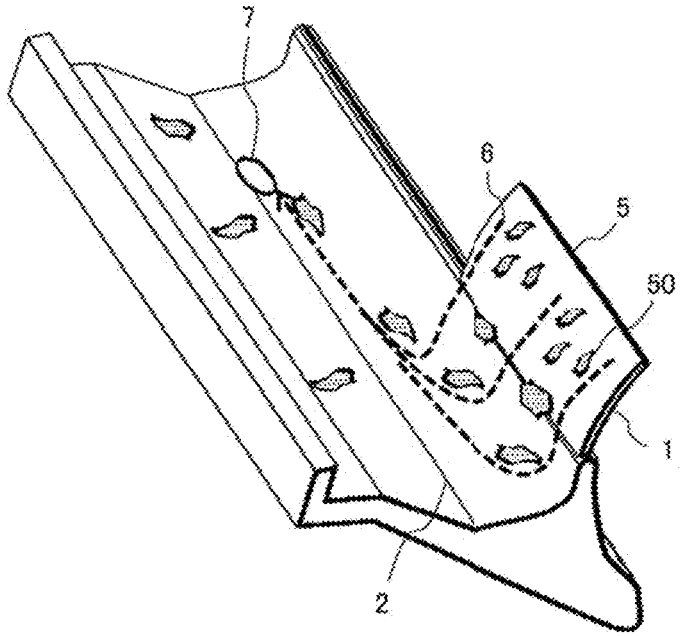
FIG. 7 is a perspective view illustrating a drain path from a first water receiving device to a drain hole in the indoor unit according to Embodiment 1 of the present disclosure.

FIG. 6 is a perspective view illustrating a drain path in the heat exchanger 11 in the indoor unit 201 according to Embodiment 1 of the present disclosure. FIG. 7 is a perspective view illustrating a drain path from the first water receiving device 1 to the drain hole 7 in the indoor unit 201 according to Embodiment 1 of the present disclosure.

As illustrated in FIGS. 6 and 7, in a surface 5 of the first water receiving device 1 that faces the heat exchanger 11, water passages are provided such the water passages are connected with the drain receiver 2. The surface 5 is a surface of the first water receiving device 1 or second water receiving device 62 that is provided to face upward and face the heat exchanger 11. Water droplets that has flowed onto the drain receiver 2 are sent to the outdoor unit 202 by the drain hose 8 after passing through the drain hole 7 by a driving force, such as gravity, and is then drawn off to flow to the outdoor space 301.

Example of Performance of Air-Conditioning Apparatus 200 in Cooling Operation As illustrated in FIG. 1, air that flows from the living space 300 into the indoor unit 201 is cooled by passing through the heat exchanger 11, and then flows into the living space 300 through the fan 12. At this time, although it depends on the humidity in the living space 300 and the temperature in the heat exchanger 11, dew condensation water is generated on the fins 31 of the heat exchanger 11. In the housing 10 of the indoor unit 201, airflow that passes through the heat exchanger 11 in the first space 101 is shaped along the surface 5 of the first water receiving device 1 that faces the heat exchanger 11, and passes through the fan 12 and then enters the room from the first opening 4. Also, in the housing 10 of the indoor unit 201, the airflow that passes through the second space 102 is changed from a flow perpendicular to the axial direction of the rotating shaft 20 of the fan 12 to a flow parallel to the rotating shaft 20, and passes through the fan 12 and then enters the room from the first opening 4 of the first space 101.

As for refrigerant that flows in the indoor unit 201, in the heat exchanger 11, liquid-based refrigerant receives heat from air in the living space 300 to change into gas-based refrigerant or gas refrigerant, and flows through the refrigerant pipe 13 into the outdoor unit 202 installed in the outdoor space 301. The refrigerant that has flowed into the outdoor unit 202 flows to the inlet of the compressor 15 through the four-way valve 16. The refrigerant is compressed by the compressor 15 into high-temperature and high-pressure gas refrigerant, and re-flows through the four-way valve 16 and flows into the outdoor heat exchanger 17. The refrigerant then transfers heat to air at the outdoor heat exchanger 17 to change into liquid-phase refrigerant or liquid-based refrigerant. Then, the refrigerant is reduced in pressure at the expansion device 19, and re-flows into the indoor unit 201.

As illustrated in FIG. 6, when water droplets 50 formed by condensation in the heat exchanger 11 of the indoor unit 201 grow to a certain size, the water droplets 50 are moved by a driving force, such as the inertial force 110 of the airflow and gravity 111. Some of the water droplets 50 move downward along the heat exchanger 11 in the direction of gravity while being held by surface tension on the fins 31 of the heat exchanger 11. The other water droplets 50 move away from the fins 31 of the heat exchanger 11 toward the downstream side of the airflow. At this time, the water droplets 50 held on the fins 31 of the heat exchanger 11 flow to the drain receiver 2. On the other hand, the water droplets 50 that has moved away from the fins 31 of the heat exchanger 11 adhere to the surface 5 of the first water receiving device 1 that faces the heat exchanger 11. As illustrated in FIG. 7, when the water droplets 50 adhering to the surface 5 re-grow to a certain size, the water droplets 50 are made to flow to the drain receiver 2, by a driving force such as gravity, through the water passages 6. The water droplets that has flowed to the drain receiver 2 are moved by driving force, such as gravity, through the drain hole 7, conveyed to the outdoor unit 202 through the drain hose 8, and drawn off to flow to the outdoor space 301.

<Degree of Freedom in Mounting Heat Exchanger 11 That Varies Because of Provision of First Water Receiving Device 1>

Figure 8:
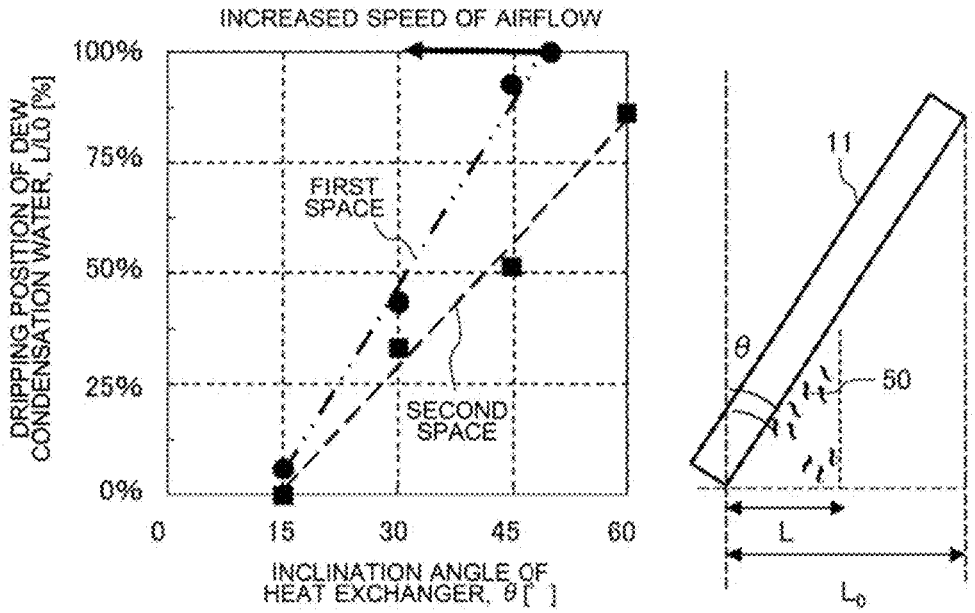
FIG. 8 is a conceptual diagram illustrating a water dripping range that depends on an inclination angle of the heat exchanger according to Embodiment 1 of the present disclosure.

FIG. 8 is a conceptual diagram illustrating a water dripping range that depends on the inclination angle of the heat exchanger 11 according to Embodiment 1 of the present disclosure.

As illustrated in FIG. 8, the first space 101 in which the first opening 4 is provided and the second space 102 in which no first opening 4 is provided are different from each other in a dripping range of dew condensation water that depends on the inclination angle of the heat exchanger 11. In the first space 101, dew condensation water drips over a wider area than in the second space 102. This is because in the first space 101, gravity or the inertial force of airflow that passes through the first opening 4 causes dew condensation water to easily drip in the form of the water droplets 50. By contrast, in the second space 102, the direction of airflow is changed from a direction perpendicular to the rotation shaft 20 to a direction parallel to the rotating shaft 20, before the airflow reaches the first opening 4. Thus, the inertial force acting on the water droplets 50 is reduced, and the degree of flying of water droplets is reduced.

Figure 9:
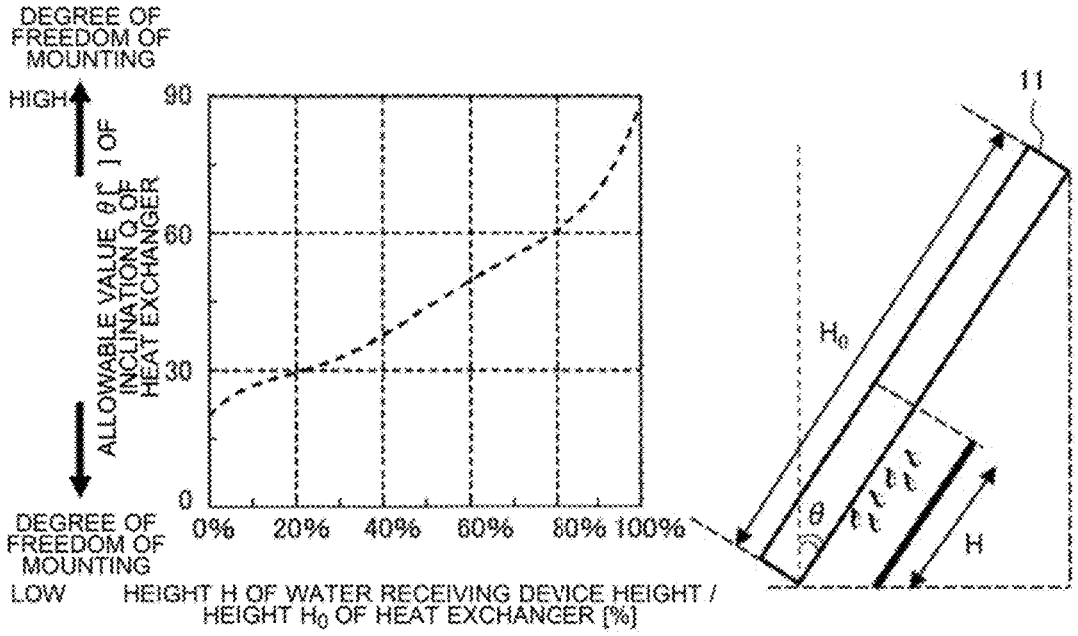
FIG. 9 is a conceptual diagram illustrating an advantage of the presence of the first water receiving device regarding improvement of the degree of freedom in mounting the heat exchanger according to Embodiment 1 of the present disclosure.

FIG. 9 is a conceptual diagram illustrating an advantage of the presence of the first water receiving device 1 regarding improvement of the degree of freedom in mounting the heat exchanger 11 according to Embodiment 1 of the present disclosure. The horizontal axis in FIG. 9 represents the ratio of the height H of the first water receiving device 1 to the height Ho of the heat exchanger 11, and the vertical axis in FIG. 9 represents an allowable value of inclination of the heat exchanger 11 in the case where the first water receiving device 1 is provided in the first space 101.

As the allowable value increases, the degree of freedom in mounting the heat exchanger 11 increases, and in accordance with the configuration, the heat exchanger 11 can be mounted in such a manner as to achieve a higher density of components. The size of the first water receiving device 1 is a design value determined based on the resistance to airflow in the housing 10, which is allowed depending on the performance of the fan 12.

The allowable value is a design matter that is determined, for example, based on the speed of airflow in the heat exchanger 11 or the surface shape of material of the fins 31. Furthermore, since at least part of the first water receiving device 1 is provided at a higher position than the drain receiver 2 in the direction of gravity, water droplets 50 adhering to the heat exchanger 11 can be guided to the drain receiver 2 by a driving force, that is, by the potential energy of water droplets 50 that drips and flies off on the first water receiving device 1 that is located at a higher position than the drain receiver 2.

<Function>

As described above, in the first space 101 in which the first opening 4 is open to the living space 300 for the user, the first water receiving device 1 is provided to prevent dew condensation water from dripping onto the fan 12. Thus, it is possible to improve a heat transfer coefficient because of an increase in the speed of airflow and the above high-density arrangement in which the heat exchanger 11 is inclined for the purpose of improving the performance. In addition, even when gravity or the inertial force of airflow causes dew condensation water to easily drip in the form of the water droplets 50, a flow along the surface 5 of the first water receiving device 1 that faces the heat exchanger 11 is made in the first space 101, thereby reducing the outflow of water from the heat exchanger 11 to the first opening 4. It is therefore possible to improve both the performance and the quality.

The upper ends of the fins 31 of the heat exchanger 11 are each located at a higher position than at least one blade of the fan 12 in the direction of gravity. That is, the upper ends of the fins 31 of the heat exchanger 11 are located at a higher position the upper end of the fan 12 on the circular path along which the fan 12 is rotated. Furthermore, the lower ends of the fins 31 of the heat exchanger 11 are provided at a lower position than the rotating shaft 20 of the fan 12 in the direction of gravity. Thus, it is possible to improve the above density in mounting in the heat exchanger 11 per volume of the housing 10 of the indoor unit 201, and improve the quality and the performance without reducing the living space 300 of the user.

<Others>

It should be noted that two or more first spaces 101 and two or more second spaces 102 may be provided in the housing 10 of the indoor unit 201, and the first spaces 101 and the second spaces 102 may be alternately arranged in the axial direction of the rotating shaft 20 of the fan 12. Also, it should be noted that heat transfer tube 30 of the heat exchanger 11 may be a flat tube. The direction of flow of refrigerant may be either parallel or perpendicular to the rotating shaft 20 of the fan 12. Although the fins 31 of the heat exchanger 11 as illustrated are plate fins, corrugated fins may be used as the fins 31. In this case also, the same advantages as described above can be obtained.

The shape of the fan 12 provided in the first space 101 may be different from that in the second space 102, and in some space, no blade may be located.

The first water receiving device 1 may cover the outer periphery of the part of the fan 12 that is located in the first space 101 and may serve as a casing for a centrifugal fan in the first space 101, as long as the first water receiving device 1 is connected to the drain receiver 2. The first water receiving device 1 and the drain receiver 2 may be molded of resin as an integral component. The part of the fan 12 that is located in the first space 101 and part of the fan 12 that is located in the second space 102 may be continuous with each other or may be formed as separate components.

The first opening 4 does not necessarily need to be provided on the lower side of the housing 10 of the indoor unit 201 in the direction of gravity. However, in the case where the first opening 4 is located on the lower side in the direction of gravity, it is more advantageous, since it is possible to reduce dripping of dew condensation water through the first opening 4, which is caused by gravity.

The number of indoor units 201 and that of outdoor units 202 are not limited to one. A plurality of indoor units 201 and a plurality of outdoor units 202 may be connected. In the middle of the refrigerant pipes 13 that connects the indoor units 201 and the outdoor units 202, a gas-liquid separator or a flow-dividing controller that controls refrigerant to be supplied to the indoor units 201 may be provided. It should be noted that the kind of refrigerant that circulates in the air-conditioning apparatus 200 is not limited to a specific one. Although in FIG. 1, the housing of the indoor unit 201 of the air-conditioning apparatus 200 is illustrated by way example as a wall-mounted housing, the configuration of the indoor unit 201 is not limited to a specific one. For example, the indoor unit 201 may be of a floor standing type, a ceiling suspended type, or a ceiling concealed type.

Advantages of Embodiment 1

In Embodiment 1, the indoor unit 201 of the air-conditioning apparatus 200 includes the fan 12 that has the rotating shaft 20 extending in the lateral direction in the housing 10. The indoor unit 201 of the air-conditioning apparatus 200 includes the heat exchanger 11 that is located upstream of the fan 12 in the air passage in the housing 10. The indoor unit 201 of the air-conditioning apparatus 200 includes the drain receiver 2 that receives water generated in the housing 10, in the vicinity of the lower end of the heat exchanger 11. In the housing 10, the first space 101 and the second space 102 are partitioned off in the axial direction of the rotating shaft 20 of the fan 12. In the first space 101, the first opening 4 is provided to allow air to flow out, and is located outward of the part of the fan 12 that is located in the first space 101 in the radial direction of the fan 12. In the second space 102, no opening is provided, that is, a region located outward of the part of the fan 12 that is located in the second space 102 is closed. In the space between the part of the fan 12 that is located in the first space 101 and the heat exchanger 11, the first water receiving device 1 is provided at a higher position than the drain receiver 2 and at least part of the above space.

In the above configuration, in the first space 101 in which the first opening 4 is provided to communicate with the living space 300 for the user, the first water receiving device 1 is provided to prevent dew condensation water from dripping from the heat exchanger 11 to the fan 12. It is therefore possible to reduce occurrence of a phenomenon in which water drips from the heat exchanger 11 to the first opening 4. In the second space 102, since an opening that allows air to flow out is not provided, the flow direction of air is turned, at a location between the heat exchanger 11 and the fan 12, from a direction perpendicular to the axial direction of the rotating shaft 20 of the fan 12 to the axial direction of the rotating shaft 20. Therefore, in the second space 102, it is possible to reduce occurrence of a phenomenon in which water drips or files off into the living space 300, which is caused by the inertial force of airflow. Thus, it is possible to incline the heat exchanger 11, mount components at a high density, improve the energy consumption performance, and reduce occurrence of a phenomenon in which water drips or files off into the living space 300. Therefore, it is possible to achieve both improvement of the energy consumption performance and improvement of the quality that is achieved by, for example, reducing occurrence of a phenomenon in which water drips or flies off.

In Embodiment 1, in the second space 102, the second water receiving device 62 is not provided in the space between the fan 12 and the heat exchanger 11, and a large air passage corresponding to the surface area of the first water receiving device 1 in the first space 101 is provided. Alternatively, in the space between the fan 12 and the heat exchanger 11 in the second space 102, the second water receiving device 62 having a surface area smaller than that of the first water receiving device 1 in the first space 101 is provided.

In the above configuration, an airflow to the downstream side that is blocked by the first water receiving device 1 in the first space 101 flows into the second space 102 in which the second water receiving device 62 is not provided and a large air passage corresponding to the surface area of the first water receiving device 1 in the first space 101 is provided, or flows into the second space 102 in which the second water receiving device 62 having a surface area smaller than that of the first water receiving device 1 in the first space 101 is provided. Thus, it is possible to reduce a decrease in air volume in the heat exchanger 11 in the first space 101, improve the heat exchange performance, and improve the energy consumption performance.

In Embodiment 1, the water passages 6 connected with the drain receiver 2 are provided in at least part of the surface 5 of the first water receiving device 1 or second water receiving device 62, which faces the heat exchanger 11 and also faces upward.

In the above configuration, water adhering to the first water receiving device 1 or the second water receiving device 62 flow to the drain receiver 2 along the water passages 6. It is therefore possible to reduce occurrence of a phenomenon in which water adhering to the first water receiving device 1 or the second water receiving device 62 flies off, reduce water accumulation that causes abnormal odor or corrosion, and improve the quality of the indoor unit 201.

In Embodiment 1, the upper end of the heat exchanger 11 is located at a higher position than the uppermost position of the circular path along the fan 12 is rotated, in the direction of gravity. The lower end of the heat exchanger 11 is located at a lower position than the rotating shaft 20 of the fan 12 in the direction of gravity.

In the above configuration, it is possible to increase the heat transfer area of the heat exchanger 11, reduce the resistance to airflow, and the airflow that enters the indoor unit 201 can efficiently perform heat exchange at the heat exchanger 11.

In Embodiment 1, the air-conditioning apparatus 200 includes the above indoor unit 201 of the air-conditioning apparatus 200.

In the above configuration, the air-conditioning apparatus 200 includes the aforementioned indoor unit 201 of the air-conditioning apparatus 200, and can achieve both the improvement of the energy consumption performance and the improvement of quality that is achieved by, for example, reducing occurrence of a phenomenon in which water drips or flies off.

Embodiment 2

Figure 10:
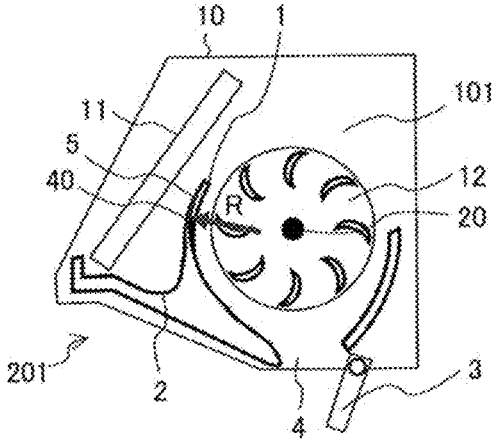
FIG. 10 is an explanatory diagram illustrating a vertical section of an indoor unit according to Embodiment 2 of the present disclosure that is taken along line A-A in FIG. 2.

FIG. 10 is an explanatory diagram illustrating a vertical section of the indoor unit 201 according to Embodiment 2 of the present disclosure that is taken along line A-A in FIG. 2. It should be noted that in Embodiment 2, descriptions of matters that are the same as those in Embodiment 1 will be omitted, and only features of Embodiment 2 will be described.

As illustrated in FIG. 10, in the first water receiving device 1, as viewed in the axial direction of the rotating shaft 20 of the fan 12, the surface 5 of the first water receiving device 1 that faces the heat exchanger 11 and faces upward is connected with the drain receiver 2 by a curved surface 40 that is an R-surface at least partially having a curvature. The curved surface 40 is a convex surface that is convex upward and toward the heat exchanger 11.

The first water receiving device 1 and the drain receiver 2 are connected by the smooth curved surface 40. Because of this configuration, at the connection between the first water receiving device 1 and the drain receiver 2, it is possible to reduce not only occurrence of a phenomenon in which water droplets fly off, but also water accumulation that causes abnormal odor or corrosion, and thus improves the quality.

In the second water receiving device 62 (not illustrated), as viewed in the axial direction of the rotating shaft 20 of the fan 12, the surface of the second water receiving device 62 that faces the heat exchanger 11 and faces upward may be connected with the drain receiver 2 by a curved surface (R-surface) at least partially having a curvature.

The first water receiving device 1 or the second water receiving device 62 may be connected to the drain receiver 2 by a separate component.

Modification 1

Figure 11:
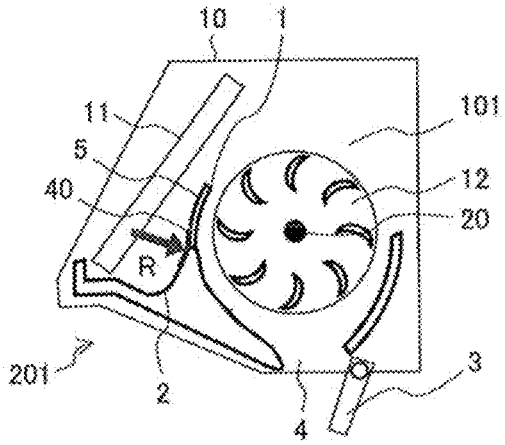
FIG. 11 is an explanatory diagram illustrating a vertical section of an indoor unit according to modification 1 of Embodiment 2 of the present disclosure that is taken along line A-A in FIG. 2.

FIG. 11 is an explanatory diagram illustrating a vertical section of the indoor unit 201 according to modification 1 of Embodiment 2 of the present disclosure that is taken along line A-A in FIG. 2. It should be noted that descriptions of matters that are the same as those in Embodiment 1 and/or Embodiment 2 will be omitted, and only features of modification 1 will be described.

As illustrated in FIG. 11, the curved surface 40 is a concave surface that faces the heat exchanger 11 in such a manner as to project downward.

Advantages of Embodiment 2

In Embodiment 2, in the first water receiving device 1 or the second water receiving device 62, as viewed in the axial direction of the rotating shaft 20 of the fan 12, the surface 5 of the first water receiving device 1 or second water receiving device 62 that faces the heat exchanger 11 and faces upward is connected with the drain receiver 2 by the curved surface 40 at least partially having a curvature therebetween.

In the above configuration, it is possible to reduce, at the connection between the drain receiver 2 and the first water receiving device 1 or the second water receiving device 62, not only a phenomenon in which water flies off, but also water accumulation that causes abnormal odor or corrosion, and thus can improve the quality of the indoor unit 201.

Embodiment 3

Figure 12:
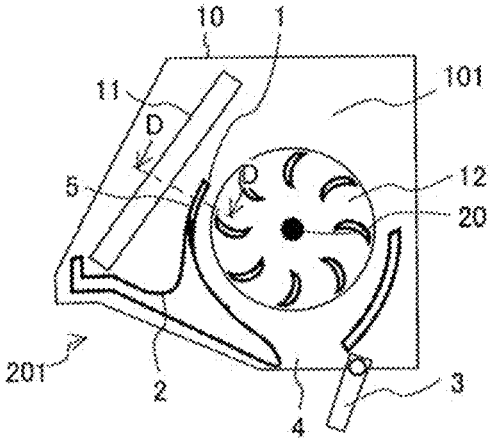
FIG. 12 is an explanatory diagram illustrating a vertical section of an indoor unit according to Embodiment 3 of the present disclosure that is taken along line A-A in FIG. 2.
Figure 13:
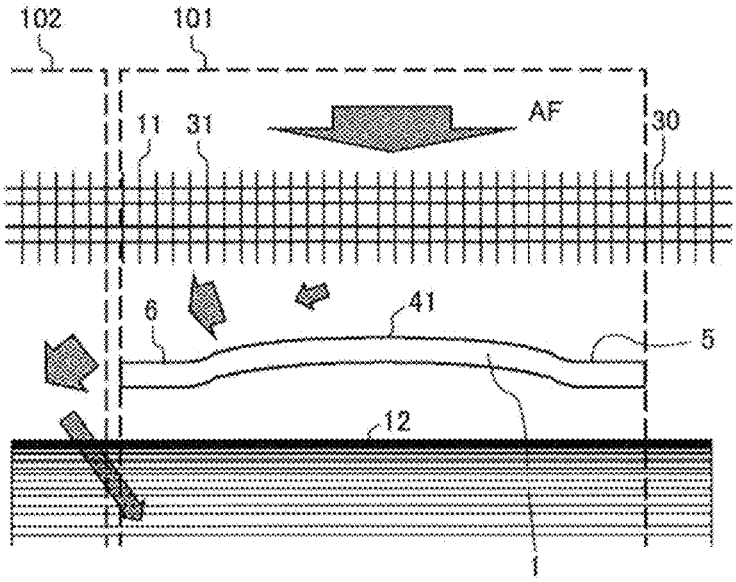
FIG. 13 is an explanatory diagram illustrating a cross section of a first water receiving device according to Embodiment 3 of the present disclosure that is taken along line D-D in FIG. 12.

FIG. 12 is an explanatory diagram illustrating a vertical section of the indoor unit 201 according to Embodiment 3 of the present disclosure that is taken along line A-A in FIG. 2. FIG. 13 is an explanatory diagram illustrating a cross section of the first water receiving device 1 according to Embodiment 3 of the present disclosure that is taken along line D-D in FIG. 12. It should be noted that descriptions of matters that are the same as each of the same matters as those in any of Embodiment 1, Embodiment 2, will be omitted, and only features of modification 1 will be described.

As illustrated in FIGS. 12 and 13, as viewed in a direction perpendicular to the axial direction of the rotating shaft 20 of the fan 12, the first water receiving device 1 has a convex portion 41 in at least part of the surface 5 that faces the heat exchanger 11 and faces upward. The convex portion 41 is formed in a central portion of the first water receiving device 1 in the axial direction of the rotating shaft 20 of the fan 12.

The water passages 6 are each provided at a position where the convex portion 41 of the surface 5 is lowered in the direction of gravity and close to an end portion of the surface 5 in the axial direction of the rotating shaft 20 of the fan 12. The water passages 6 are provided at respective end portions that are other than the convex portion 41, that is, at both the end portions that are other than the central portion of the first water receiving device 1 in the axial direction of the rotating shaft 20 of the fan 12.

As viewed in a direction perpendicular to the rotating shaft 20 of the fan 12, at least part of the surface of the second water receiving device 62 that faces the heat exchanger 11 and faces upward may have a convex portion. The water passage may be provided at a position where the convex portion of the above surface of the second water receiving device 62 is lowered in the direction of gravity, and close to the end portion of the above surface in the axial direction of the rotating shaft 20 of the fan 12.

In the above configuration, the space between the heat exchanger 11 and the surface 5 of the first water receiving device 1 or the second water receiving device 62 that faces the heat exchanger 11 can be widened at end portions of the first water receiving device 1 or the second water receiving device 62. Therefore, it is possible to reduce the resistance to an airflow that moves along the surface 5, reduce a decrease in air volume in the heat exchanger 11 in the first space 101, and improve the performance of the heat exchanger 11. Furthermore, the water passages 6 are provided at end portions of the surface 5, and it is possible to reduce the probability that water droplets will run down the end portions of the surface 5 to enter the first opening 4. It is therefore possible to improve both the performance and the quality.

Modification 2

Figure 14:
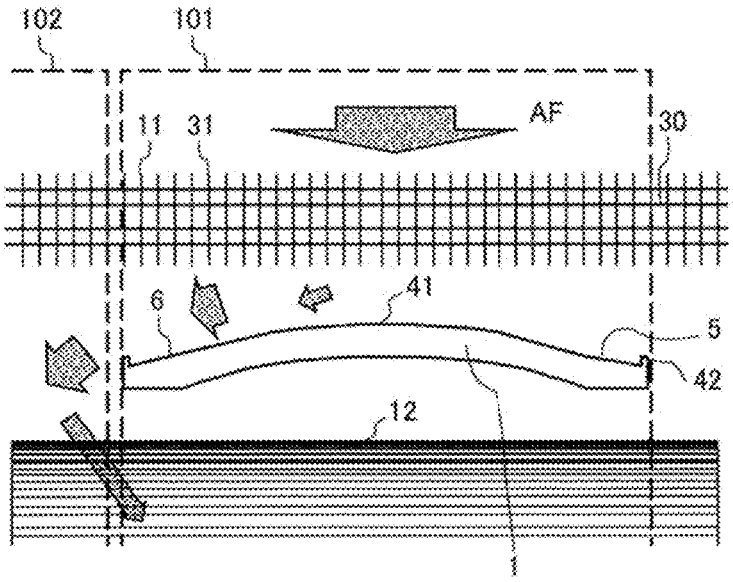
FIG. 14 is an explanatory diagram illustrating a cross section of a first water receiving device according to modification 2 of Embodiment 3 of the present disclosure that is taken along line D-D in FIG. 12.

FIG. 14 is an explanatory diagram illustrating a cross section of the first water receiving device 1 according to modification 2 of Embodiment 3 of the present disclosure that is taken along line D-D in FIG. 12. It should be noted that regarding modification 2, descriptions of matters that are the same as those in any of Embodiment 1, Embodiment 2, Embodiment 3, and modification 1 will be omitted, and only features of modification 2 will be described.

As illustrated in FIG. 14, as viewed in a direction perpendicular to the axial direction of the rotating shaft 20 of the fan 12, the first water receiving device 1 has hook-like protrusions 42 that protrude upward from respective end portions of the water passage 6.

In the above configuration, water droplets 50 are caused to flow, by gravity, along each of the protrusions 42 onto the drain receiver 2. Thus, it is possible to more reliably reduce the entry of water droplets into the first opening 4 and improve the quality.

Modification 3

Figure 15:
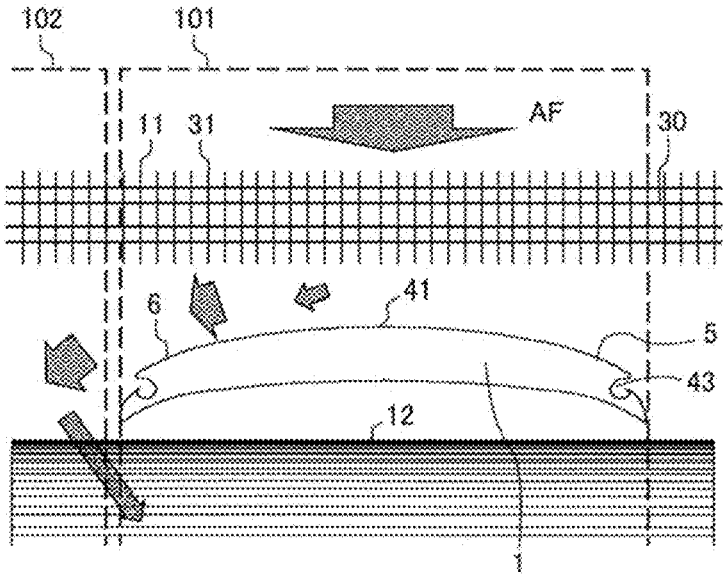
FIG. 15 is an explanatory diagram illustrating a cross section of a first water receiving device according to modification 3 of Embodiment 3 of the present disclosure that is taken along line D-D in FIG. 12.

FIG. 15 is an explanatory diagram illustrating a cross section of the first water receiving device 1 according to modification 3 of Embodiment 3 of the present disclosure that is taken along line D-D in FIG. 12. It should be noted that regarding modification 3, descriptions of matters that are the same as those in any of Embodiment 1, Embodiment 2, Embodiment 3, modification 1, and modification 2 will be omitted, and only features of modifications will be described.

As illustrated in FIG. 15, in the first water receiving device 1, as viewed in a direction perpendicular to the axial direction of the rotating shaft 20 of the fan 12, the water passage 6 is provided such that the surface 5 is formed to have a groove 43 that is recessed downward from the surface 5.

Because of provision of the groove 43, the water droplets 50 are guided by surface tension into the groove 43 and caused to flow, by gravity, onto the drain receiver 2. Thus, it is possible to further reduce the entry of water droplets into the first opening 4 and improve the quality. Since an airflow along the surface 5 is less turbulent than that in the groove 43, the resistance to the airflow is reduced and the heat exchange performance is improved.

Modification 4

Figure 16:
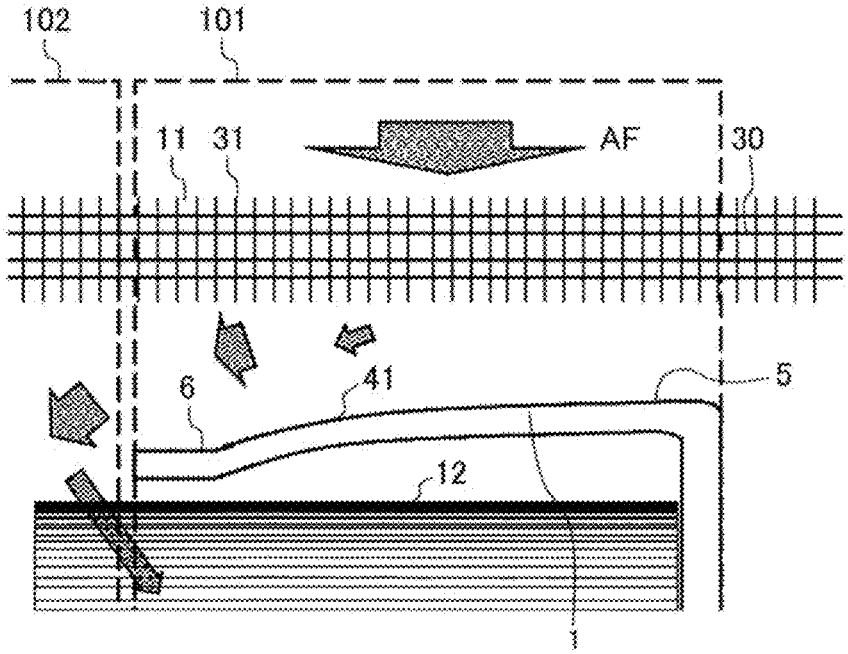
FIG. 16 is an explanatory diagram illustrating a cross section of a first water receiving device according to modification 4 of Embodiment 3 of the present disclosure that is taken along line D-D in FIG. 12.

FIG. 16 is an explanatory diagram illustrating a cross section of the first water receiving device 1 according to modification 4 of Embodiment 3 of the present disclosure that is taken along line D-D in FIG. 12. It should be noted that regarding modification 4, descriptions of matters that are the same as those in any of Embodiment 1, Embodiment 2, Embodiment 3, modification 1, modification 2, and modification 3 will be omitted, and only features of modification 4 will be described.

As illustrated in FIG. 16, the convex portion 41 is formed such that in the axial direction of the rotating shaft 20 of the fan 12, an end portion of the first water receiving device 1 that is located opposite to the second space 102 is raised toward the heat exchanger 11 and the other end portion of the first water receiving device 1 that adjoins the second space 102 is lowered from the heat exchanger 11.

The water passage 6 is provided at a position where the convex portion 41 of the surface 5 is recessed in the direction of gravity, and close to the end portion of the surface 5 of the first water receiving device 1, which adjoins the second space 102 in the axial direction of the rotating shaft 20 of the fan 12. A single water passage 6 is provided in a region that is other than the convex portion 41, that is, only at the end portion of the first water receiving device 1 that adjoins the second space 102 in the axial direction of the rotating shaft 20 of the fan 12.

In the configuration as illustrated in FIG. 16, the space between the surface 5 of the first water receiving device 1 that faces the heat exchanger 11 and the heat exchanger 11 is widened at the end portion of the first water receiving device 1 that adjoins the second space 102. Thus, it is possible to reduce the resistance to the airflow along the surface 5 in the central part of the indoor unit 201 where the first space 101 and the second space 102 join each other, reduce a decrease in air volume in the heat exchanger 11 in the first space 101, improve the heat exchange performance, and improve the energy consumption performance. Thus, the water passage 6 is provided at the above end portion of the surface 5, it is possible to reduce water that runs down the end portion of the surface 5 into the first opening 4, and thus to reduce occurrence of a phenomenon in which water drips or flies into the living space 300. Therefore, it is possible to achieve both improvement of the energy consumption performance and improvement of the quality that is achieved by, for example, reducing occurrence of a phenomenon in which water drips or flies off.

Advantages of Embodiment 3

In Embodiment 3, as viewed in a direction perpendicular to the axial direction of the rotating shaft 20 of the fan 12, the first water receiving device 1 or the second water receiving device 62 has the convex portion 41 in at least part of the surface 5 that faces the heat exchanger 11 and faces upward. The water passage 6 is provided at a position where the convex portion 41 is lowered in the direction of gravity, and close to the end portion of the surface 5 in the axial direction of the rotating shaft 20 of the fan 12.

In the above configuration, the space between the heat exchanger 11 and the surface 5 of the first water receiving device 1 or second water receiving device 62 that faces the heat exchanger 11 is widened at an end portion of the first water receiving device 1 or the second water receiving device 62. Thus, it is possible to reduce the resistance to the airflow along the surface 5, reduce a decrease in air volume in the heat exchanger 11 in the first space 101 or the second space 102, improve the heat exchange performance, and improve the energy consumption performance. Furthermore, the water passage 6 is provided at an end portion of the surface 5, and it is possible to reduce water that runs down the end portion of the surface 5 into the first opening 4, and thus to reduce occurrence of a phenomenon in which water drips or flies off into the living space 300. Therefore, it is possible to achieve both improvement of the energy consumption performance and improvement of the quality that is achieved by, for example, reducing a phenomenon in which water drips or flies off.

Embodiment 4

Figure 17:
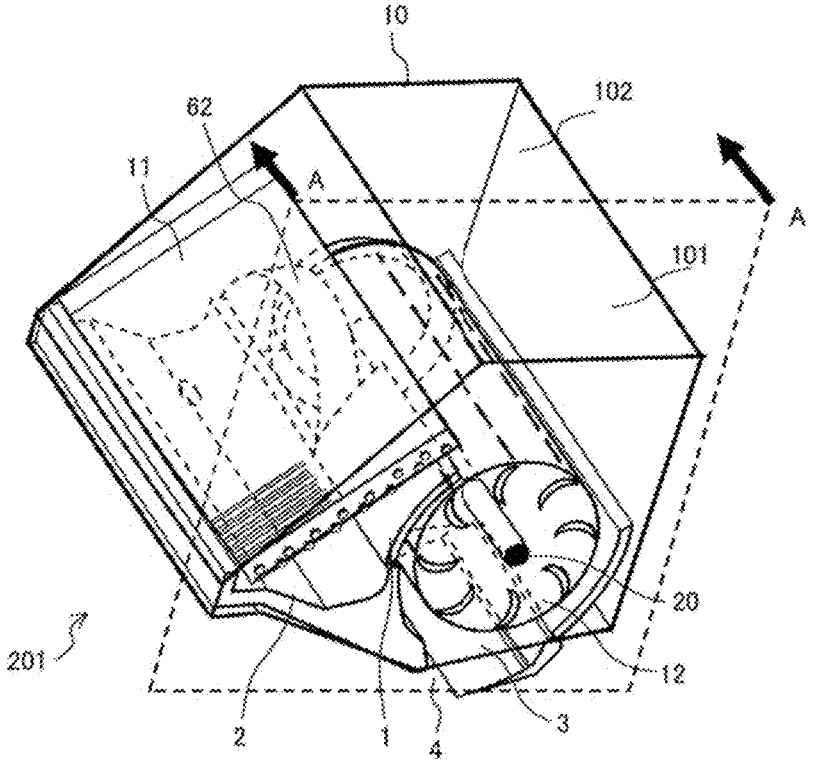
FIG. 17 is a perspective view of an indoor unit according to Embodiment 4 of the present disclosure.
Figure 18:
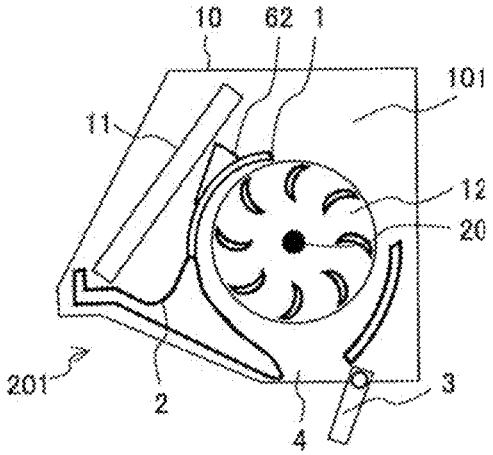
FIG. 18 is an explanatory diagram illustrating a vertical section of the indoor unit according to Embodiment 4 of the present disclosure that is taken along line A-A in FIG. 17.

FIG. 17 is a perspective view of the indoor unit 201 according to Embodiment 4 of the present disclosure. FIG. 18 is an explanatory diagram illustrating a vertical section of the indoor unit 201 according to Embodiment 4 of the present disclosure that is taken along line A-A in FIG. 17. It should be noted that regarding Embodiment 4, descriptions of matters that are the same as those in any of Embodiment 1, Embodiment 2, Embodiment 3, modification 1, modification 2, modification 3, and modification 4 will be omitted, and only features of Embodiment 4 will be described.

As illustrated in FIGS. 17 and 18, the indoor unit 201 includes the first water receiving device 1 in the first space 101. The indoor unit 201 includes the second water receiving device 62 in the second space 102. The second water receiving device 62 in the second space 102 has a surface area smaller than that of the first water receiving device 1 in the first space 101.

As viewed in the axial direction of the rotating shaft 20 of the fan 12, the distance between at least part of the second water receiving device 62 and the rotating shaft 20 of the fan 12 is greater than the distance between the first water receiving device 1 and the rotating shaft 20 of the fan 12. To be more specific, as viewed from the first space 101 in the axial direction of the rotating shaft 20, part of the second water receiving device 62 protrudes from the first water receiving device 1 toward the heat exchanger 11.

Because of provision of the second water receiving device 62, it is possible to reduce adhesion of the water droplets 50 to the fan 12, prevent water droplets from running down the fan 12 and flying off into the first opening 4 in the first space 101, and thus improve the quality. Furthermore, the distance between at least part of the second water receiving device 62 and the rotating shaft 20 of the fan 12 is greater than that between the first water receiving device 1 and the rotating shaft 20 of the fan 12. It is therefore possible to reduce blockage of the flow passage of airflow, reduce the resistance to airflow, and improve the heat exchange performance.

In the second water receiving device 62, a water passage connected with the first water receiving device 1 may be provided. In this case, the second water receiving device 62 does not necessarily need to be connected to the drain receiver 2 in the second space 102.

Modification 5

Figure 19:
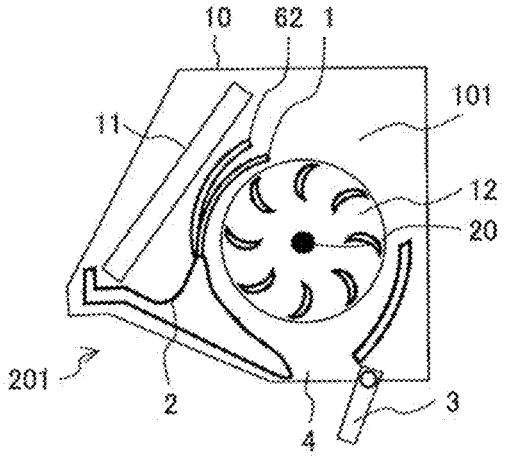
FIG. 19 is an explanatory diagram illustrating an indoor unit according to modification 5 of Embodiment 4 of the present disclosure that is taken along line A-A in FIG. 17.

FIG. 19 is an explanatory diagram illustrating a vertical section of the indoor unit 201 according to modification 5 of Embodiment 4 of the present disclosure that is taken along line A-A in FIG. 17. It should be noted that descriptions of matters that are the same as those in any of Embodiment 1, Embodiment 2, Embodiment 3, Embodiment 4, modification 1, modification 2, modification 3, and modification 4 will be omitted, and only features of modification 5 will be described.

As illustrated in FIG. 19, the second water receiving device 62 may be configured to be connected to the drain receiver 2, not to the first water receiving device 1.

In the configuration as illustrated in FIG. 19, it is possible to cause the water droplets 50 on the second water receiving device 62 to flow directly to the drain receiver 2, design the first water receiving device 1 and the second water receiving device 62 in accordance with the shape of the fan 12 in the first space 101 and the shape of the fan 12 in the second space 102, and improve the heat exchange performance.

Advantages of Embodiment 4

In Embodiment 4, in the first space 101, the first water receiving device 1 is provided, and in the second space 102, the second water receiving device 62 is provided. As viewed in the axial direction of the rotating shaft 20 of the fan 12, the distance between at least part of the second water receiving device 62 and the rotating shaft 20 of the fan 12 is greater than the distance between the first water receiving device 1 and the rotating shaft 20 of the fan 12.

In the above configuration, it is possible to reduce blockage of airflow that is caused by the second water receiving device 62, and also reduce the resistance to airflow, thereby improving the energy consumption performance.

Embodiment 5

Figure 20:
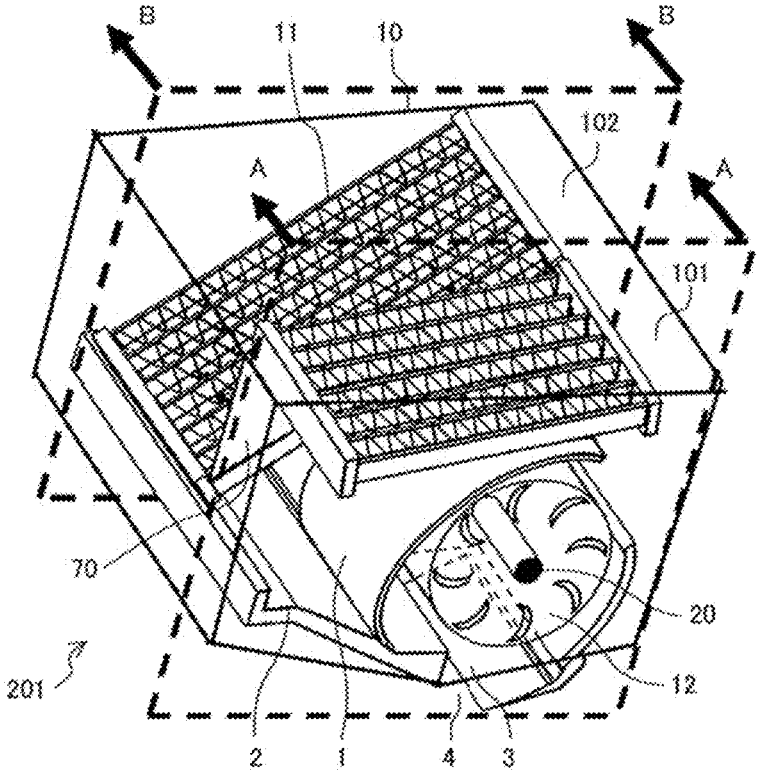
FIG. 20 is a perspective view of an indoor unit according to Embodiment 5 of the present disclosure.
Figure 21:
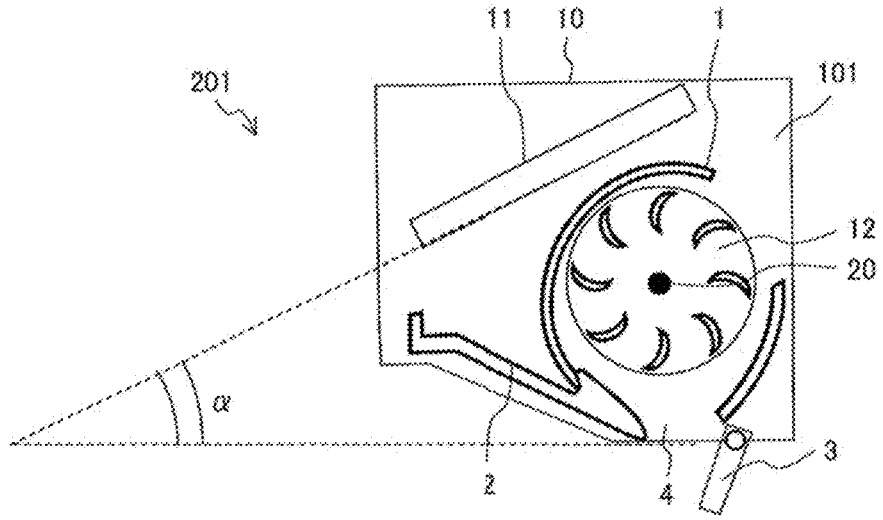
FIG. 21 is an explanatory diagram illustrating a vertical section of the indoor unit according to Embodiment 5 of the present disclosure that is taken along line A-A in FIG. 20.
Figure 22:
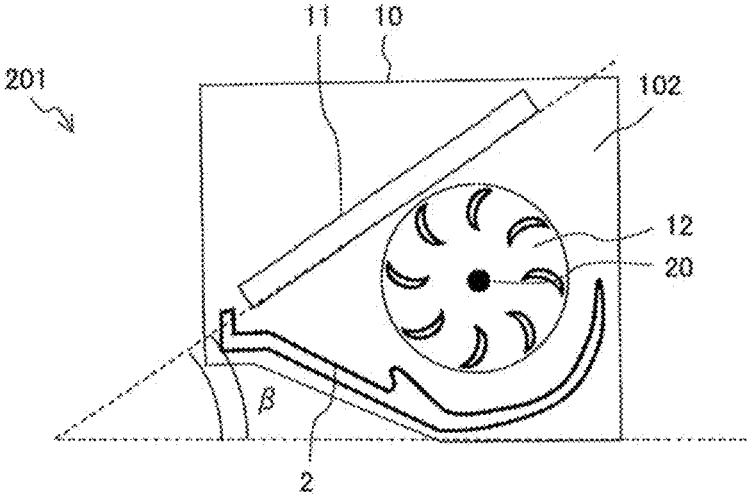
FIG. 22 is an explanatory diagram illustrating a vertical section of the indoor unit according to Embodiment 5 of the present disclosure that is taken along line B-B in FIG. 20.

FIG. 20 is a perspective view of the indoor unit 201 according to Embodiment 5 of the present disclosure. FIG. 21 is an explanatory diagram illustrating a vertical section of the indoor unit 201 according to Embodiment 5 of the present disclosure that is taken along line A-A in FIG. 20. FIG. 22 is an explanatory diagram illustrating a vertical section of the indoor unit 201 according to Embodiment 5 of the present disclosure that is taken along line B-B in FIG. 20. It should be noted that descriptions of matters that are the same as those in any of Embodiment 1, Embodiment 2, Embodiment 3, Embodiment 4, modification 1, modification 2, modification 3, modification 4, and modification 5 will be omitted, and only features of Embodiment 5 will be described.

As illustrated in FIGS. 20, 21, and 22, the inclination angle of a heat exchanger 11 provided in the first space 101 to the horizontal direction is different from that of a heat exchanger 11 provided in the second space 102 to the horizontal direction. That is, the heat exchangers 11 are provided as separate components in the respective spaces, i.e., the first space 101 and the second space 102.

The relationship $\alpha<\beta$ is satisfied, where a is the inclination angle of the heat exchanger 11 in the first space 101 to the horizontal direction, and $\beta$ is the inclination angle of the heat exchanger 11 in the second space 102 to the horizontal direction. Therefore, a point at which an imaginary line extending while being inclined at the inclination angle $\alpha$ of the heat exchanger 11 in the first space 101 to the horizontal direction intersects a horizontal line is more distant from the heat exchanger 11 than a point at which an imaginary line extending while being inclined at the inclination angle of the heat exchanger 11 in the second space 102 to the horizontal direction intersects the horizontal line.

As illustrated in FIG. 20, in the case where the inclination angle of the heat exchanger 11 in the first space 101 is different from that of the heat exchanger 11 in the second space 102 to the horizontal direction, a partitioning member 70 is provided at a boundary between the first space 101 and the second space 102 in such a manner to extend in a direction perpendicular to the rotating shaft 20 of the fan 12. The partitioning member 70 blocks airflow that bypasses the heat exchanger 11 in the second space 102, at the boundary.

The inclination angle $\beta$ of the heat exchanger 11 in the second space 102 to the horizontal direction is greater than that of the heat exchanger 11 in the first space 101 to the horizontal direction. Thus, in the second space 102, dew condensation water flows down between the fins 31 of the heat exchanger 11, and then drips at a lower position than the heat exchanger 11 in the first space 101. Thus, it is possible reduce occurrence of a phenomenon in which water files off from the second space 102 into the living space 300, and to improve the quality. Furthermore, it is possible to further increase the heat transfer area of the heat exchanger 11 in the second space 102, as compared with the case where the heat exchanger 11 is provided at the same angle as in the first space 101, improve the heat exchange performance, reduce the resistance to airflow, and thus also improve the energy consumption performance.

Advantages of Embodiment 5

In Embodiment 5, the inclination angle of the heat exchanger 11 in the first space 101 to the horizontal direction are different from of the heat exchanger 11 in the second space 102 to the horizontal direction. The relationship $\alpha<\beta$ is satisfied, where a is the inclination angle of the heat exchanger 11 in the first space 101 to the horizontal direction, and $\beta$ is the inclination angle of the heat exchanger 11 in the second space 102 to the horizontal direction in the second space 102.

In the above configuration, the inclination angle $\beta$ of the heat exchanger 11 in the second space 102 to the horizontal direction is large. Thus, water generated in the heat exchanger 11 flows in the heat exchanger 11 itself and is drawn off. It is therefore possible to reduce occurrence of a phenomenon in which water files off into the living space 300, and improve the quality. The heat transfer area of the heat exchanger 11 in the second space 102 can be increased in the case where the heat exchanger 11 in the second space 102 is inclined at the same angle as the heat exchanger 11 in the first space 101. Thus, the performance of each of the heat exchanger 11 can be improved, the resistance to airflow can be reduced, and the energy consumption performance can be improved.

In Embodiment 5, in the case where the inclination angle of the heat exchanger 11 in the first space 101 to the horizontal direction is different from that of the heat exchanger 11 in the second space 102 to the horizontal direction, the partitioning member 70 that blocks airflow bypassing the heat exchanger 11 in the second space 102 is provided at the boundary between the heat exchanger 11 in the first space 101 and the heat exchanger 11 in the second space 102 in a direction perpendicular to the rotation shaft 20 of the fan 12.

In the above configuration, the partitioning member 70 can prevent generation of airflow that bypasses the heat exchanger 11, deterioration of the performance of the heat exchanger 11 can be prevented, and the energy consumption performance can be improved.

Embodiment 6

Figure 23:
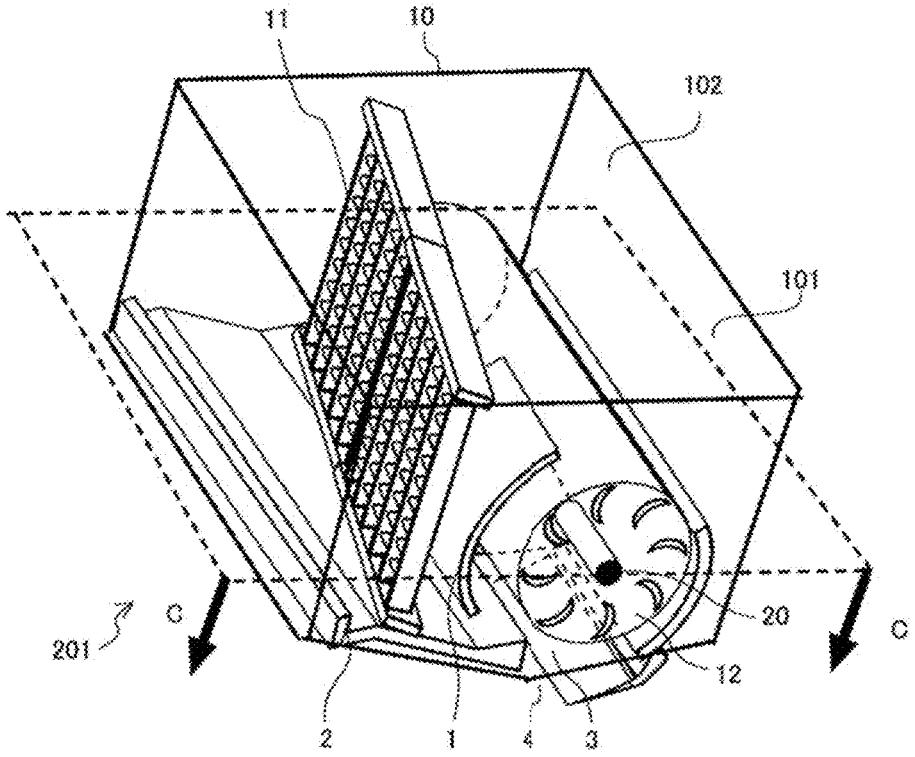
FIG. 23 is a perspective view of an indoor unit according to Embodiment 6 of the present disclosure.
Figure 24:
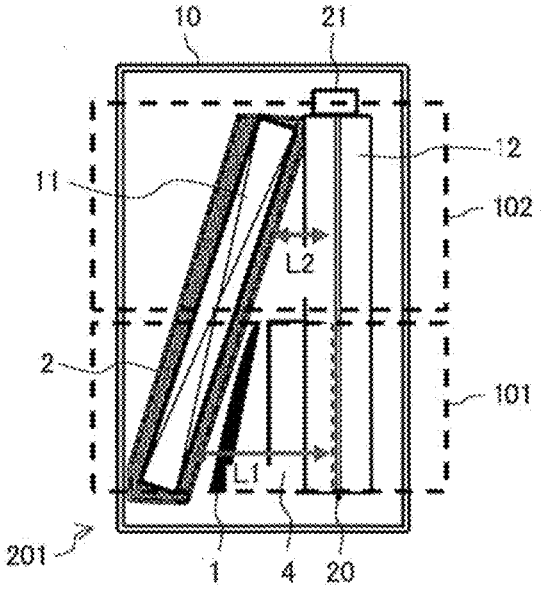
FIG. 24 is an explanatory diagram illustrating a cross section of the indoor unit according to Embodiment 6 of the present disclosure that is taken along line C-C in FIG. 23.

FIG. 23 is a perspective view of the indoor unit 201 according to Embodiment 6 of the present disclosure. FIG. 24 is an explanatory diagram illustrating a cross section of the indoor unit 201 according to Embodiment 6 of the present disclosure that is taken along line C-C in FIG. 23. It should be noted that descriptions of matters that are the same as those in any of Embodiment 1, Embodiment 2, Embodiment 3, Embodiment 4, Embodiment 5, modification 1, modification 2, modification 3, modification 4, and modification 5 will be omitted, and only features of Embodiment 6 will be described.

As illustrated in FIG. 23 and FIG. 24, the relationship L2<L1 is satisfied, where L1 is the distance between the rotating shaft 20 of the fan 12 and the heat exchanger 11 in the first space 101, and L2 is the distance between the rotating shaft 20 of the fan 12 and the heat exchanger 11 in the second space 102.

The heat exchanger 11 provided in the first space 101 and the heat exchanger 11 provided in the second space 102 are continuous with each other such that the heat exchangers 11 are inclined to the axial direction of the rotating shaft 20 of the fan 12.

In the configuration as illustrated in FIG. 23 and FIG. 24, the heat transfer area of each of the heat exchangers 11 is larger and the heat exchange performance is higher than in the case where the heat exchangers 11 are provided parallel to the rotating shaft 20 of the fan 12. In addition, the distance from the heat exchanger 11 in the second space 102 to the first opening 4 in the first space 101 is smaller. Thus, in the axial direction of the rotating shaft 20 of the fan 12, variation in the volume of air that passes through the heat exchanger 11 in the second space 102 can be reduced, and the heat exchange performance can be improved.

Advantages of Embodiment 6

In Embodiment 6, the relationship L2<L1 is satisfied, where L1 is the distance between the rotating shaft 20 of the fan 12 and the heat exchanger 11 in the first space 101, and L2 is the distance between the rotating shaft 20 of the fan 12 and the heat exchanger 11 in the second space 102.

In the above configuration, the heat transfer area of each of the heat exchangers 11 is larger and the heat exchange performance is thus higher than in the case where the heat exchangers 11 are provided parallel to the rotating shaft 20 of the fan 12. Also, the distance from the heat exchanger 11 in the second space 102 to the first opening 4 in the first space 101 is smaller. Thus, in the axial direction of the rotating shaft 20 of the fan 12, variation in the volume of airflow passing through the heat exchanger 11 in the second space 102 can be reduced, and the heat exchange performance can be improved.

In Embodiment 6, the heat exchanger 11 in the first space 101 and the heat exchanger 11 in the second space are continuous with each other such that the heat exchangers 11 are inclined to the axial direction of the rotating shaft 20 of the fan 12.

In the above configuration, the heat exchanger 11 in the first space 101 and the heat exchanger 11 in the second space 102 are continuous with each other. Thus, the number of components is reduced.

Embodiment 7

Figure 25:
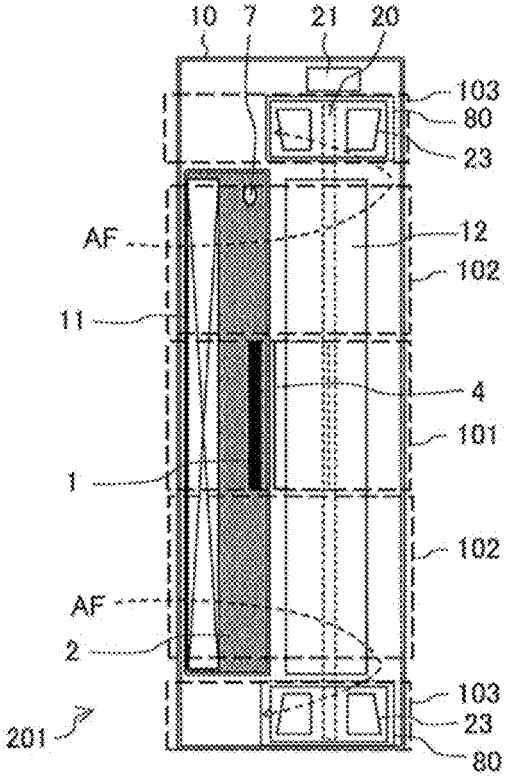
FIG. 25 is an explanatory diagram illustrating a cross section of an indoor unit according to Embodiment 7 of the present disclosure that is taken along line C-C in FIG. 2.

FIG. 25 is an explanatory diagram illustrating a cross section of the indoor unit 201 according to Embodiment 7 of the present disclosure that is taken along line C-C in FIG. 2. It should be noted that descriptions of matters that are the same as those in any of Embodiment 1, Embodiment 2, Embodiment 3, Embodiment 4, Embodiment 5, Embodiment 6, modification 1, modification 2, modification 3, modification 4, and modification 5 will be omitted, and only features of Embodiment 7 will be described.

As illustrated in FIG. 25, third spaces 103 that face respective second spaces 102 are formed in at least part of the housing 10 of the indoor unit 201 that is partitioned in the axial direction of the rotating shaft 20 of the fan 12. In the third space 103, the heat exchanger 11 is not provided, and a second opening 80 is provided to allow air to flow out.

A single first space 101 is provided at the center of the indoor unit 201. In the first space 101, the first opening 4 is provided. The second spaces 102 are provided on respective sides the first space 101 in the axial direction of the rotating shaft 20 of the fan 12. The third spaces 103 are each of formed on one side of an associated one of the two second spaces 102 that is adjacent to an associated one of sides of the indoor unit 201 in the axial direction of the rotating shaft 20 of the fan 12. In the two third spaces 103, respective second openings 80 are provided.

The first water receiving device 1 is provided, but the second water receiving device 62 is not provided.

The direction of airflow in the second space 102 that faces the third space 103 is changed from a direction perpendicular to the axial direction of the rotating shaft 20 of the fan 12 to the axial direction of the rotating shaft 20, on the way to the second opening 80 in the third space 103 in the flow of air toward the second opening 80. Thus, the inertial force acting on the water droplets 50 is small, and occurrence of a phenomenon in which the water droplets 50 fly off from the second opening 80 can be reduced.

In each of the third spaces 103, a fan 23 attached to the rotating shaft 20 is provided. As the fan 23, a centrifugal fan, such as a turbofan, is used. Thus, even in the case where the first water receiving device 1 is made larger, and interferes with the flow of air in the first space 101, the air pressure and the air volume are improved, the heat exchange performance is improved, thus improving both the performance and the quality.

Modification 6

Figure 26:
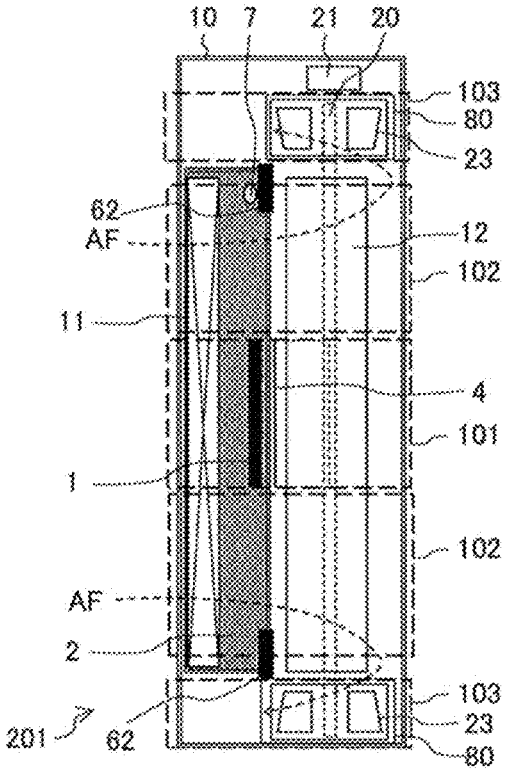
FIG. 26 is an explanatory diagram illustrating a cross section of an indoor unit according to modification 6 of Embodiment 7 of the present disclosure that is taken along line C-C in FIG. 2.

FIG. 26 is an explanatory diagram illustrating cross section of the indoor unit 201 according to modification 6 of Embodiment 7 of the present disclosure that is taken along line C-C in FIG. 2. It should be noted that descriptions of matters that are the same as those in any of Embodiment 1, Embodiment 2, Embodiment 3, Embodiment 4, Embodiment 5, Embodiment 6, Embodiment 7, modification 1, modification 2, modification 3, modification 4, and modification 5 will be omitted, and only features of modification 6 will be described.

As illustrated in FIG. 26, second water receiving devices 62 are each provided close to the boundary between an associated one of the second spaces 102 and an associated one of the third spaces 103. Because of provision of the second water receiving device 62, even in the case where the volume of air from the fan 23 in the third space 103 is increased to improve the heat exchange performance, it is possible to reduce occurrence of a phenomenon in which water droplets files off from the second opening 80 in the third space 103.

Advantages of Embodiment 7

In Embodiment 7, the third space 103 that faces the second space 102 is provided in at least part of the housing 10 that is partitioned in the axial direction of the rotating shaft 20 of the fan 12. In the third space 103, the heat exchanger 11 is not provided and the second opening 80 is provided to allow air to flow out.

In the above configuration, the direction of airflow in the second space 102 that faces the third space 103 is changed from a direction perpendicular to the axial direction of the rotating shaft 20 of the fan 12 to the axial direction of the rotating shaft 20, on the way to the second opening 80 in the third space 103. Thus, it is possible to reduce the inertial force acting on the water droplets 50, and thus reduce occurrence of a phenomenon in which water files off from the second opening 80.

Embodiments 1 to 7 of the present disclosure may be combined or applied to other parts.

REFERENCE SIGNS LIST

1 first water receiving device, 2 drain receiver, 3 vertical air vent deflector, 4 first opening, 5 surface, 6 water passage, 7 drain hole, drain hose, 10 housing, 11 heat exchanger, 12 fan, 13 refrigerant pipe, 14 housing, 15 compressor, 16 four-way valve, 17 outdoor heat exchanger, 18 fan, 19 expansion device, 20 rotating shaft, 21 drive source, 23 fan, 30 heat transfer tube, 31 fin, 40 curved surface, 41 convex portion, 42 protrusion, 43 groove, 50 water droplet, 62 second water receiving device, 70 partitioning member, 80 second opening, 101 first space, 102 second space, 103 third space, 110 inertial force, 111 gravity, 200 air-conditioning apparatus, 201 indoor unit, 202 outdoor unit, 300 living space, 301 outdoor space

The invention claimed is:

1. An indoor unit of an air-conditioning apparatus, comprising:

a fan including a rotating shaft that extends in a lateral direction in a housing;

a heat exchanger provided in the housing and upstream of the fan in an air passage; and a drain receiver configured to receive water at a position close to a lower end of the heat exchanger, the water being generated in the housing, wherein an interior of the housing is partitioned into a first space and a second space in an axial direction of the rotating shaft of the fan, the first space being a space in which a first opening is provided to allow air to flow out toward a region located outward of the fan in the first space in a radial direction of the fan, the second space being a space in which no opening is provided and a region located outward of the fan in the second space in the radial direction of the fan is closed, in at least part of a space between the fan and the heat exchanger in the first space, a first water receiving device is provided at a higher position than the drain receiver, and in a space between the fan and the heat exchanger in the second space, a second water receiving device having a surface area smaller than a surface area of the first water receiving device in the first space is provided, or the second water receiving device is not provided and an air passage corresponding to the surface area of the first water receiving device in the first space is provided.

2. The indoor unit of an air-conditioning apparatus of claim 1, wherein a water passage connected with the drain receiver is provided in at least part of a surface of the first water receiving device or the second water receiving device that faces the heat exchanger.

3. The indoor unit of an air-conditioning apparatus of claim 1, wherein an upper end of the heat exchanger is provided at a higher position than an uppermost position of a circular path along which the fan is rotated, in a direction of gravity; and a lower end of the heat exchanger is provided at a lower position than the rotating shaft of the fan in the direction of gravity.

4. The indoor unit of an air-conditioning apparatus of claim 1, wherein as viewed in the axial direction of the rotating shaft of the fan, a surface of the first water receiving device or the second water receiving device that faces the heat exchanger is connected with the drain receiver by a curved surface at least partially having a curvature.

5. The indoor unit of an air-conditioning apparatus of claim 1, wherein as viewed in a direction perpendicular to the axial direction of the rotating shaft of the fan, at least part of a surface of the first water receiving device or the second water receiving device that faces the heat exchanger has a convex portion; and a water passage is provided at a position where the convex portion is lowered in a direction of gravity, and close to an end portion of the surface in the axial direction of the rotating shaft of the fan.

6. The indoor unit of an air-conditioning apparatus of claim 1, wherein in the first space, the first water receiving device is provided, and in the second space, the second water receiving device is provided; and as viewed in the axial direction of the rotating shaft of the fan, a distance between at least part of the second water receiving device and the rotating shaft of the fan is greater than a distance between the first water receiving device and the rotating shaft of the fan.

7. An indoor unit of an air-conditioning apparatus, comprising:

a fan including a rotating shaft that extends in a lateral direction in a housing;

a heat exchanger provided in the housing and upstream of the fan in an air passage; and a drain receiver configured to receive water at a position close to a lower end of the heat exchanger, the water being generated in the housing, wherein an interior of the housing is partitioned into a first space and a second space in an axial direction of the rotating shaft of the fan, the first space being a space in which a first opening is provided to allow air to flow out toward a region located outward of the fan in the first space in a radial direction of the fan, the second space being a space in which no opening is provided and a region located outward of the fan in the second space in the radial direction of the fan is closed, in at least part of a space between the fan and the heat exchanger in the first space, a first water receiving device is provided at a higher position than the drain receiver, and an inclination angle of part of the heat exchanger that is located in the first space to a horizontal direction and an inclination angle of part of the heat exchanger that is located in the second space to the horizontal direction are different from each other, and $\alpha<\beta$ is satisfied, where $\alpha$ is the inclination angle of the part of the heat exchanger that is located in the first space to the horizontal direction, and $\beta$ is the inclination angle of the part of the heat exchanger that is located in the second space to the horizontal direction.

8. The indoor unit of an air-conditioning apparatus of claim 7, wherein in a case where the inclination angle of the part of the heat exchanger that is located in the first space to the horizontal direction and the inclination angle of the part of the heat exchanger that is located in the second space to the horizontal direction are different from each other, the heat exchanger includes a partitioning member at a boundary between the part of the heat exchanger in the first space and the part of the heat exchanger in the second space, the boundary being perpendicular to the rotating shaft of the fan, the partitioning member being configured to block airflow that bypasses the heat exchanger.

9. An indoor unit of an air-conditioning apparatus, comprising:

a fan including a rotating shaft that extends in a lateral direction in a housing;

a heat exchanger provided in the housing and upstream of the fan in an air passage; and a drain receiver configured to receive water at a position close to a lower end of the heat exchanger, the water being generated in the housing, wherein an interior of the housing is partitioned into a first space and a second space in an axial direction of the rotating shaft of the fan, the first space being a space in which a first opening is provided to allow air to flow out toward a region located outward of the fan in the first space in a radial direction of the fan, the second space being a space in which no opening is provided and a region located outward of the fan in the second space in the radial direction of the fan is closed, in at least part of a space between the fan and the heat exchanger in the first space, a first water receiving device is provided at a higher position than the drain receiver, and $L2<L1$ is satisfied, where L1 is a distance between the rotating shaft of the fan and part of the heat exchanger that is located in the first space and L2 is a distance between the rotating shaft of the fan and part of the heat exchanger that is located in the second space.

10. The indoor unit of an air-conditioning apparatus, of claim 9, wherein the part of the heat exchanger that is located in the first space and the part of the heat exchanger that is located in the second space are continuous with each other such that the part of the heat exchanger that is located in the first space and the part of the heat exchanger that is located in the second space are inclined to the axial direction of the rotating shaft of the fan.

11. An indoor unit of an air-conditioning apparatus, comprising:

a fan including a rotating shaft that extends in a lateral direction in a housing;

a heat exchanger provided in the housing and upstream of the fan in an air passage; and a drain receiver configured to receive water at a position close to a lower end of the heat exchanger, the water being generated in the housing, wherein an interior of the housing is partitioned into a first space and a second space in an axial direction of the rotating shaft of the fan, the first space being a space in which a first opening is provided to allow air to flow out toward a region located outward of the fan in the first space in a radial direction of the fan, the second space being a space in which no opening is provided and a region located outward of the fan in the second space in the radial direction of the fan is closed, in at least part of a space between the fan and the heat exchanger in the first space, a first water receiving device is provided at a higher position than the drain receiver, and a third space that faces the second space is formed in at least part of the housing that is partitioned in the axial direction of the rotating shaft of the fan, the third space being a space in which the heat exchanger is not provided and a second opening is provided to allow air to flow out.

12. An air-conditioning apparatus comprising the indoor unit of an air-conditioning apparatus of claim 1.

* * * * *